United States Patent [19]

Kodama

[11] Patent Number: 4,763,891

[45] Date of Patent: Aug. 16, 1988

[54] SHEET FEED DEVICE FOR ELECTRONIC COPIER, PRINTER, ETC.

[75] Inventor: Yutaka Kodama, Tokyo, Japan

[73] Assignee: Ricoh Company, Ltd., Tokyo, Japan

[21] Appl. No.: 791,065

[22] Filed: Oct. 24, 1985

[30] Foreign Application Priority Data

Oct. 30, 1984 [JP] Japan ..... 59-229517
Oct. 30, 1984 [JP] Japan ..... 59-229516

[51] Int. Cl.[4] ..... B65H 1/14

[52] U.S. Cl. ..... 271/157; 271/9; 271/126; 271/127

[58] Field of Search ..... 271/126, 127, 147, 157, 271/158, 159, 160, 9, 110, 111, 162, 164

[56] References Cited

U.S. PATENT DOCUMENTS

| | | | |
|---|---|---|---|
| 3,655,183 | 4/1972 | Wagner | 271/127 |
| 4,231,566 | 11/1980 | Suzuki | 271/157 |
| 4,285,510 | 8/1981 | Kanno et al. | 271/127 |
| 4,346,878 | 8/1982 | Aizawa | 271/127 |
| 4,390,175 | 6/1983 | Takahashi | 271/157 |
| 4,466,604 | 8/1984 | Kishimoto et al. | 271/157 |
| 4,488,718 | 12/1984 | Tamura | 271/127 |
| 4,516,764 | 5/1985 | Tamura | 271/127 |
| 4,535,982 | 8/1985 | Mochmura | 271/127 |

FOREIGN PATENT DOCUMENTS

| | | | |
|---|---|---|---|
| 0119636 | 9/1980 | Japan | 271/157 |
| 0135039 | 8/1983 | Japan | 271/157 |
| 0183532 | 10/1983 | Japan | 271/162 |
| 0039638 | 3/1984 | Japan | 271/127 |

*Primary Examiner*—Joseph J. Rolla
*Assistant Examiner*—Frederick R. Handren
*Attorney, Agent, or Firm*—Oblon, Fisher, Spivak, McClelland & Maier

[57] ABSTRACT

A sheet feed device for use with a sheet feed tray of the type having a movable bottom plate and a tray cover holds the bottom plate in a raised, sheet feed position whenever the tray cover is closed, and in a lowered, sheet supply position whenever it is open. A reversible motor is drivably connected by gears or a sprocket and chain device to an arm which is adapted to raise and lower the bottom plate. The motor is controlled responsive to an output of a tray cover position sensor which senses an open position and a closed position of the tray cover.

14 Claims, 4 Drawing Sheets

SHEET FEED DEVICE FOR ELECTRONIC COPIER, PRINTER, ETC.

BACKGROUND OF THE INVENTION

The present invention relates to a sheet feed device installed in an electronic copier, printer or like apparatus for feeding sheets one by one to a predetermined station in the apparatus.

In the art of electronic copiers, printers, etc., there is known a sheet feed device, or sheet feeder, of the type using a sheet feed tray which includes a movable bottom plate for carrying a stack of sheets thereon, and a plurality of gears which are selectively driven by a motor to raise the sheets on the bottom plate to a predetermined sheet feed position. Specifically, as the gears rotate driven by the motor, a pivotal lever is moved to raise the bottom plate of the tray until the sheet stack on the tray reaches the sheet feed position. The tray is provided with a cover which is openable for replacement or supply of sheets.

In a prior art sheet feeder of the type described, sheets are replaced or supplied by pulling the sheet feed tray out of the housing of, for example, an electronic copier and canceling the intermesh between the gears so that the bottom plate of the tray is lowered from the sheet feed position to an initial or sheet supply position. The problem with such a sheet feeder is that when the tray is inserted again into the housing after the replacement or supply of sheets, the gears are apt be intermeshed only incompletely causing the bottom plate of the tray to fail to rise or, if successfully risen, to collapse afterward.

SUMMARY OF THE INVENTION

It is therefore an object of the present invention is to provide a sheet feeder for an electronic copier, printer or the like which frees the bottom plate of a sheet feed tray from incomplete rise, accidental collapse, and other undesirable occurrences.

It is another object of the present invention to provide a sheet feeder for an electronic copier, printer or the like which promotes the ease of sheet supply.

It is another object of the present invention to provide a generally improved sheet feeder for an electronic copier, printer or the like.

A sheet feed device for feeding sheets which are stacked on a movable bottom plate of a sheet feed tray one by one toward a predetermined position inside of an apparatus in which the tray is mounted of the present invention comprises a reversible motor selectively rotatable in opposite directions, a raising and lowering member for selectively raising the bottom plate of the sheet feed tray to a first predetermined position and lowering the bottom plate to a second predetermined position, a gearing for transmitting the reversible rotation of the motor to the raising and lowering member, a tray cover position sensor for sensing an open position and a closed position of a tray cover which is hinged to the sheet feed tray, and a control for driving the motor in one direction responsive to an output of the tray cover position sensor which is indicative of the closed position of the tray cover and in the other direction responsive to an output of the tray cover position sensor which is indicative of the open position of the tray cover. The raising and lowering member raises the bottom plate of the sheet feed tray responsive to the rotation of the motor in the one direction and lowers it responsive to the rotation of the motor in the other direction.

In accordance with the present invention, a sheet feed device for use with a sheet feed tray of the type having a movable bottom plate and a tray cover holds the bottom plate in a raised, sheet feed position whenever the tray cover is closed, and in a lowered, sheet supply position whenever it is open. A reversible motor is drivably connected by gears or a sprocket and chain device to an arm which is adapted to raise and lower the bottom plate. The motor is controlled responsive to an output of a tray cover position sensor which senses an open position and a closed position of the tray cover, and to an output of a sheet which senses absence of sheets on the bottom plate.

The above and other objects, features and advantages of the present invention will become more apparent from the following detailed description taken with the accompanying drawings.

DESCRIPTION OF THE PREFERRED EMBODIMENT

While the sheet feeder for an electronic copier, printer or the like of the present invention is susceptible of numerous physical embodiments, depending upon the environment and requirements of use, a substantial number of the herein shown and described embodiments have been made, tested and used, and all have performed in an eminently satisfactory manner.

Figure 1:
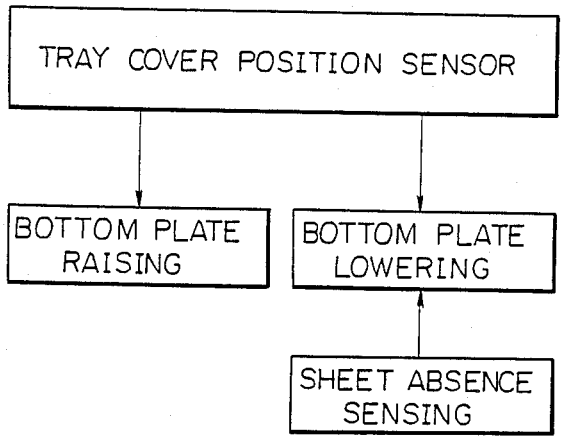
FIG. 1 is a schematic block diagram representative of essential functions of a sheet feeder in accordance with the present invention.

Referring to FIG. 1 of the drawings, essential functions of the sheet feeder of the present invention are shown in a scehmatic block diagram. A sheet feeder to which the present invention pertains is of the type in which the rotation of a reversible motor is selectively transmitted by a predetermined gearing to a bottom plate of a sheet feed tray to raise and lower the bottom plate. When the bottom plate is raised, sheets stacked on the bottom plate are brought to a predetermined sheet feed position. The tray is provided with a cover which is openable for replacement and supply of sheets. As shown in FIG. 1, the sheet feeder in accordance with the present invention essentially fulfills four different functions, i.e. sensing open and closed positions of the tray cover, raising the bottom plate by forwardly rotating the motor to the sheet feed position when a closed position of the tray cover is sensed, and lowering the bottom plate to a sheet supply position by reversely rotating the motor when an open position of the tray cover is sensed, and sensing absence of sheets on the bottom plate which also lowers the bottom plate to the sheet supply position.

Figure 2:
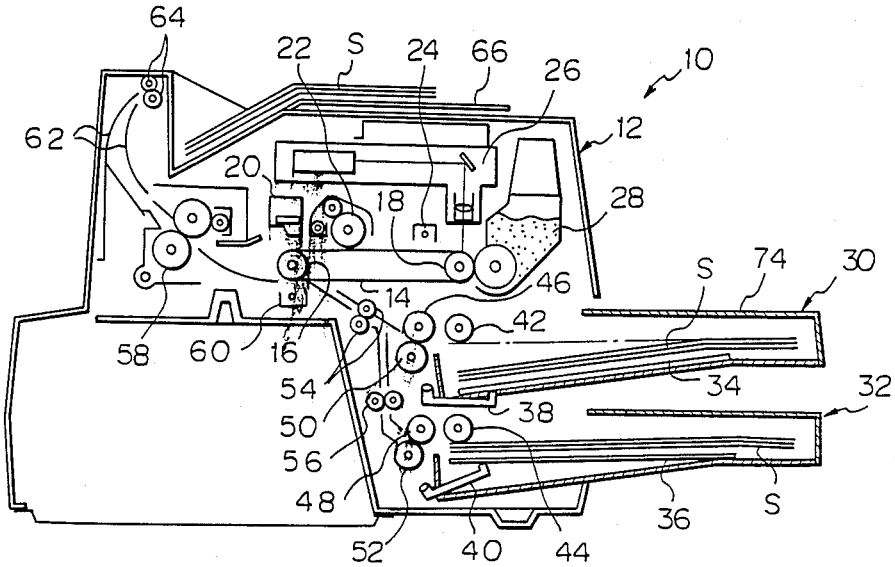
FIG. 2 is a schematic section of a printer to which a sheet feeder embodying the present invention is applied.

Referring to FIG. 2, there is shown a printer to which a sheet feeder embodying the present invention and fulfilling the functions shown in FIG. 1 is applied. It should be noted that the printer is not more than an exemplary application of the present invention and may be replaced with an electronic copier or the like. The printer, generally 10, includes a housing 12 in which a photoconductive element 14 in a form of endless belt is installed. The belt 14 is passed over a pair of rollers 16 and 18 to be driven thereby. Arranged sequentially around the belt 14 are a discharger 20, a cleaning unit 22, a charger 24, an imaging unit 26, and a developing unit 28 which cooperate to provide a toner image representative of image information by a predetermined imaging process.

Sheet feed trays 30 and 32 each being loaded with a stack of sheets S are mounted in the housing 12 and provided with bottom plates 34 and 36, respectively. While the above-mentioned imaging process is under way, a sheet S is fed from one of the trays 30 and 32 to a predetermined position by a sheet feed arrangement associated with the selected tray. As shown, the sheet feed arrangement comprises an arm 38 or 40 for raising the bottom plate 34 or 36, prefeed rolls 42 or 44, feed rolls 46 or 48, separation rolls 50 or 52, and squeeze rollers 54 or 56. The sheet S is temporarily stopped at the predetermined position and, when the leading end of a toner image carried on the belt 14 has aligned with the leading end of the sheet S, fed again to a fixing unit 58 via a transfer unit 60. Thereafter, the sheet S is routed along sheet guides 62 toward discharge rollers 64 and driven by the rollers 64 onto a discharge tray 66.

Since the trays 30 and 32 and their associated sheet feed arrangements share essentially the same construction with each other, the following description will concentrate to the tray 30 and its associated sheet feed arrangement by way of example.

Figure 3:
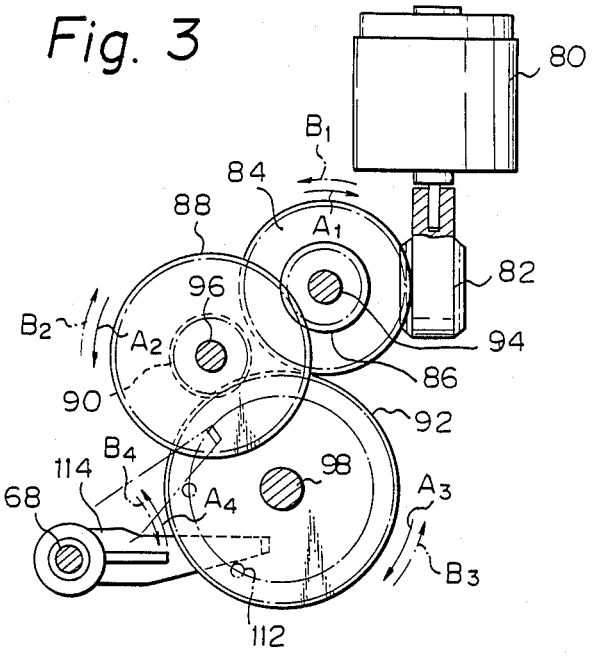
FIG. 3 is a fragmentary side elevation of a sheet feed section of the printer shown in FIG. 2.
Figure 4:
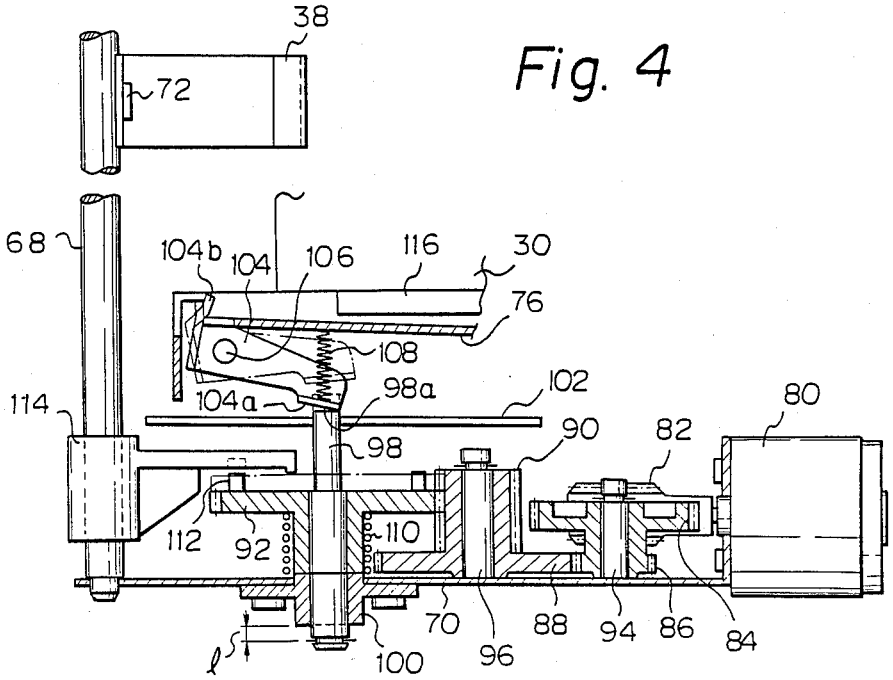
FIG. 4 is a partly taken away plan view of a part of the sheet feed section.
Figure 5:
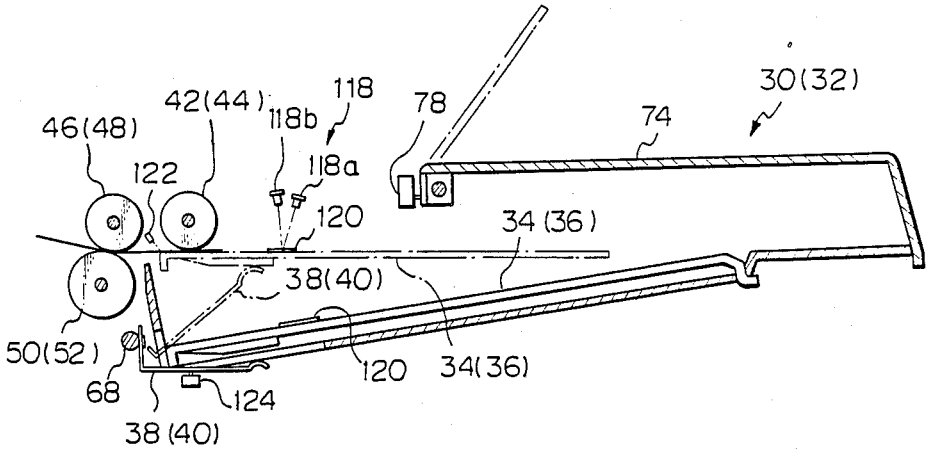
FIG. 5 is a view showing the operation of the sheet feed section.

Referring to FIGS. 3-5, a shaft 68 is journalled to a pair of side walls 70 (only one is shown) of the housing 12. The arm 38 associated with the tray 30 is fastened to the shaft 68 by a screw 72. As the tray 30 is inserted into the housing 12 with a tray cover 74 thereof closed and along a guide 76 which is fixed to the housing side wall 70, a tray cover position sensor 78, FIG. 5, is turned on. This causes a motor 80 having a worm gear 82 therewith to rotate forwardly. First to fifth gears 84, 86, 88, 90 and 92 are sequentially intermeshed as illustrated, the first gear 84 meshing with the worm gear 82 of the motor 80. Upon rotation of the motor 80, therefore, the first and second gears 84 and 86 are rotated in a direction indicated by an arrow $A_1$ and FIG. 3, the third and fourth gears 88 and 90 are rotated in a diretion indicated by an arrow $A_2$, and the fifth gear 92 is rotated in a direction indicated by an arrow $A_3$. The first and second gears 84 and 86 are formed integrally and coaxially with each other and free to rotate on a stub 94 which is studded on the housing side wall 70. Likewise, the third and fourth gears 88 and 90 are formed integrally and coaxially with each other and freely rotatable on a stub 96 which is also studded on the side wall 70. The fifth gear 92 is rigid on a shaft 98 which is rotatably and slidably supported by a bearing 100, which is fixed to the side wall 70, and another side wall 102. The shaft 98 is slidable in the up-down direction as viewed in FIG. 4 while being held in mesh with the fourth gear 90.

An interlock plate 104 is pivotted to a pin 106 and bent at opposite ends to have abutments 104*a* and 104*b*. The abutment 104*a* is located to face one end 98*a* of the slidable shaft 98. A coiled compression spring 108 is loaded between the abutment 104*a* and the guide 76 to constantly bias the interlock plate 104 clockwise about the pin 106 as viewed in FIG. 4. Another coiled compression spring 110 is loaded between the fifth gear 92 and the housing side wall 70. The biasing force of the spring 108 is greater than that of the spring 110. In this construction, while the sheet feed tray 30 is not loaded in the housing 12, the slide shaft 98 and, therefore, the fifth gear 92 is urged by the spring 108 downwardly as viewed in FIG. 4 overcoming the force of the spring 110. A pin 112 is studded on the gear 92, while a lever 114 is rigidly mounted on the shaft 68 to move the arm 38 as will be described. When the gear 92 is in the lowered position as viewed in FIG. 4, the in 112 on the gear 92 is movable along a path which does not interfere with a path along which the lever 114 is movable.

As the tray 30 is moved deeper into the housing 12 with the tray cover 74 closed, a guide piece 116 extending sideways from the tray 30 cams, leftwardly as viewed in FIG. 4, the second abutment 104*b* of the interlock plate 104 which is protruding into the path of the tray 30 at one end of the guide 76, before the gears 84-92 begin to rotate. As a result, the interlock plate 104 is rotated counterclockwise as viewed in FIG. 4 about the pin 106 and against the force of the spring 108 so that the first abutment 104*a* is moved away from the end 98*a* of the slide shaft 98. The slide shaft 98 now free from the restraint of the abutment 104*a* is urged by the spring 110 upwardly as viewed in FIG. 4. Here, the distance l over which the slide shaft 98 is moved is selected such that the path of rotation of the pin 112 on the gear 92 which moves integrally with the slide shaft 98 extends into the path of angular movement of the lever 114. Therefore, upon rotation of the gears 84-92 in the specific directions $A_1$-$A_3$, the pin 112 on the gear 92 urges the lever 114 together with the shaft 68 counterclockwise as indicated by an arrow $A_4$ in FIG. 3, overcoming gravity. Then the arm 38 which is integral with the shaft 68 pushes up the bottom plate 34 of the tray 30 until the top of the sheet stack S on the bottom plate 34 makes contact with the periphery of the prefeed rolls 42. Thereafter, the previously stated sheet feed arrangement feeds the sheets S one by one out of the tray 30.

A sheet sensor 118 is positioned in the sheet feed section inside the printer housing 12 for sensing presence/absence of sheets S on the bottom plate 34 of the tray 30. The sheet sensor 118 comprises a light emitting element 118*a* and a light sensitive element 118*b* and may be constructed such that, when the lowermost sheet S in the stack on the bottom plate 34 has been fed out, it senses a mark 120 which is provided on the then naked bottom plate 34. The output of the sheet sensor 118 is applied to a display 121 which is provided on a control/display panel of the housing 12 for urging an operator to supply sheets. The display 121 may be implemented by light emitting diodes, for example.

Assume that the display 121 has alerted the operator to the absence of sheets S in the tray 30. As the operator opens the tray cover 74 of the tray 30 with the intention of loading the tray 30 with a fresh stack of sheets S, the tray cover position sensor 78 which has been turned on at the time of mounting the tray 30 is turned off. Then, the motor 80 is reversely rotated to in turn rotate the gears 84-92 in specific directions as indicated by arrows $B_1$, $B_2$ and $B_3$ in FIG. 3. As a result, the pin 112 on the gear 92 is lowered to allow the lever 114 to move downwardly by gravity as indicated by an arrow $B_4$ in FIG. 3. The arm 38 which is integral with the lever 114 through the shaft 68 is lowered so that the bottom plate 34 is lowered to prepare the tray 30 for reception of fresh sheets S. Disposed in the path along which the stack of sheets S moves upward is a bottom plate up sensor 112 for sensing that the bottom plate 34 is in its raised position, i.e. sheet feed position. Meanwhile, a bottom plate down sensor 124 is located in the path along which the arm 38 moves downward for sensing that the bottom plate 34 is in its lowered position. i.e. sheet supply position.

Figure 6:
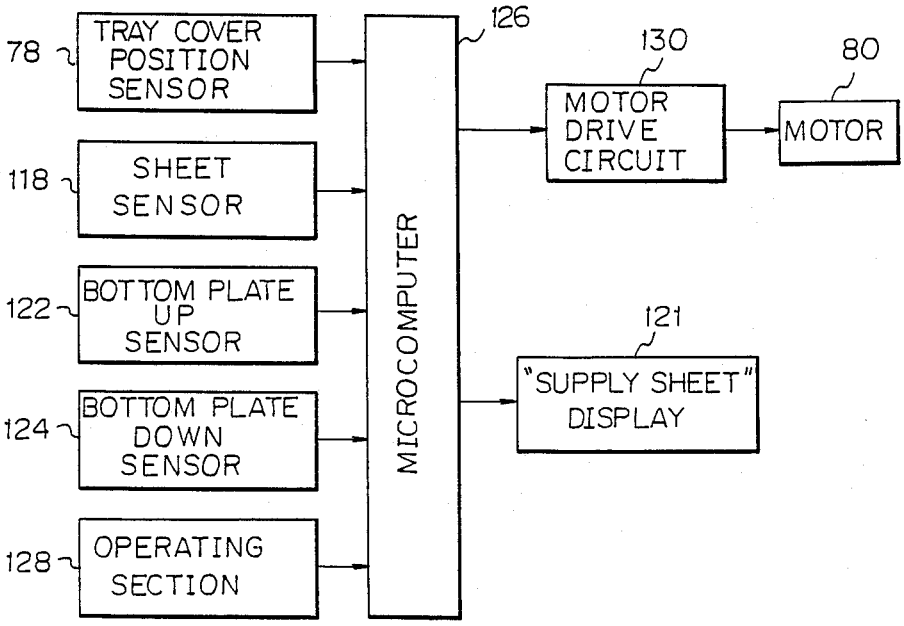
FIG. 6 is a block diagram of a controller for controlling the operation of the sheet feeder of the present invention.

Referring to FIG. 6, a controller associated with the sheet feeder of the present invention is shown. As shown, outputs of the tray cover position sensor 78, sheet sensor 118, bottom plate up sensor 122 and bottom plate down sensor 124 are applied to a microcomputer (CPU) 126. Also applied to the CPU 126 are various informations which are entered through a power key, print start key and others located in an operating section 128. A motor driver 130 for driving the motor 80, the display 121 for displaying sheet absence, and others are connected to output ports of the CPU 126.

Figure 7:
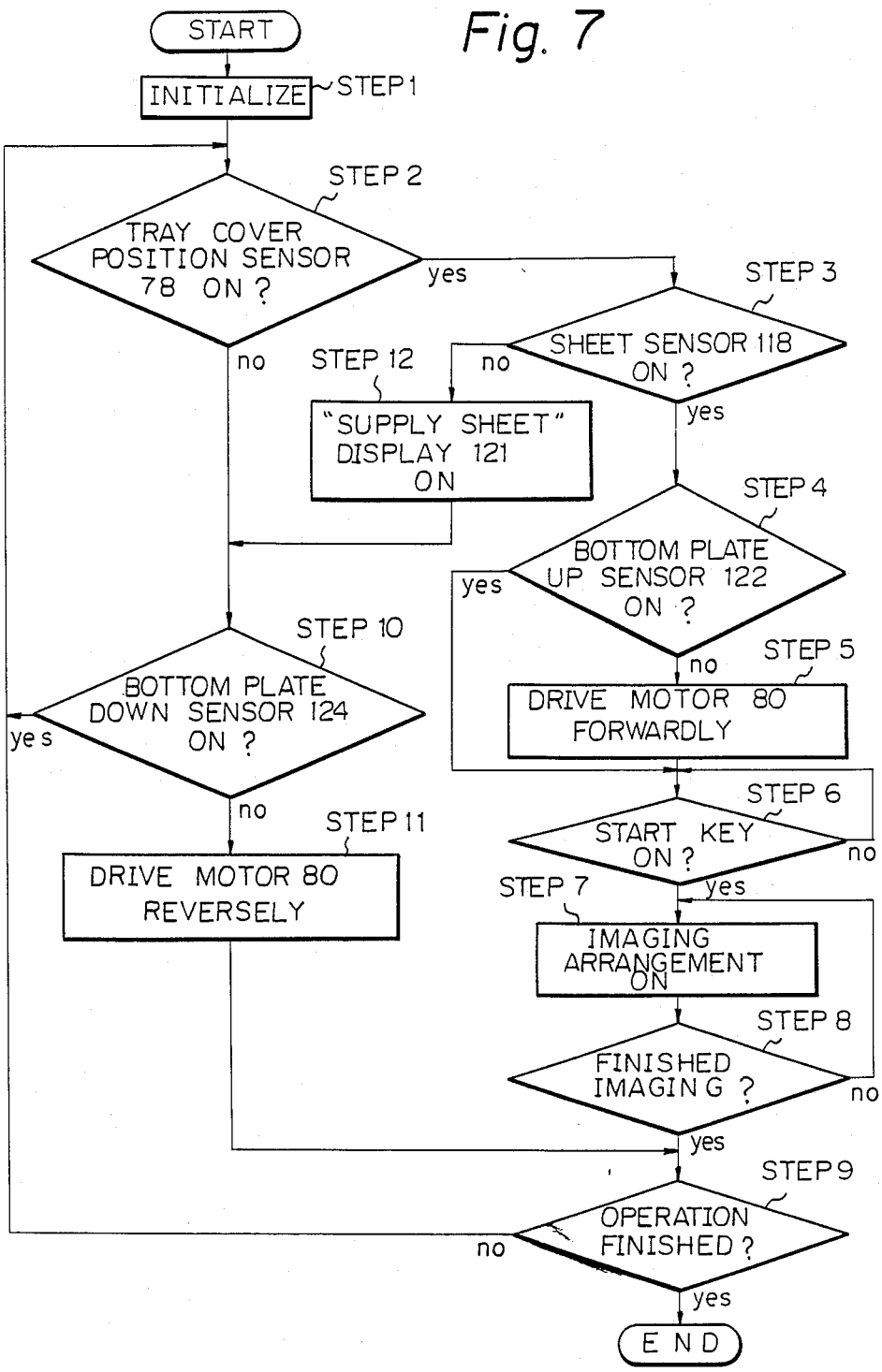
FIG. 7 is a flowchart demonstrating the operation of the sheet feeder of the present invention.

Referring to FIG. 7, there is shown a flowchart which demonstrates the operation of the sheet feeder having the above-described construction and arrangement. The operation proceeds according to a program which is stored in a read only memory (ROM) included in the CPU 126. When the power key in the operating section 128 has been turned on, the CPU 126 initializes the imaging forming arrangement and others which are installed in the housing 12 (STEP 1). Then, the CPU 126 determines whether the tray cover position sensor 78 has been turned on (STEP 2) and, if it has, determines whether the sheet sensor 118 has been turned on (STEP 3). If the result of the STEP 3 is positive, that is, when the CPU 126 has determined that sheets S are present on the bottom plate 34 of the tray 30, it decides whether the bottom plate up sensor 122 has been turned on (STEP 4). If the sensor 122 has not been turned on, the motor 80 is rotated forwardly to raise the bottom plate 34 to the sheet feed position (STEP 5). When the bottom plate 34 has been raised to reach the sheet feed position, the sensor 122 is turned on the deenergize the motor 80.

Thereafter, whether the print start key has been turned on is determined (STEP 6) and, if it has, the image forming arrangement is activated (STEP 7). This is followed by deciding whether the image forming arrangement has finished the imaging operation (STEP 8). If not, the flow returns to the STEP 7 to maintain the image forming arrangement activated. If the imaging operation has been finished as determined at the STEP 8, whether the operation of the printer has been completed is decided (STEP 9). If not, the flow returns to the STEP 2.

Meanwhile, if the result of the STEP 2 is negative, that is, if the tray cover 74 of the tray 30 is open, whether the bottom plate down sensor 124 has been turned on is determined (STEP 10). If it has not been turned on, meaning that the bottom plate 34 is not in the sheet supply position, the motor 80 is rotated reversely to lower the bottom plate 34 (STEP 11). As soon as the bottom plate 34 reaches the sheet supply position, the CPU 126 decides at the STEP 10 that the bottom plate down sensor 124 has become turned on and, then, returns to the STEP 2 to deenergize the motor 80.

If the CPU 126 decides at the STEP 3 that the sheet sensor 118 has not been turned on, meaning that no sheet S is present on the bottom plate 34, it turns on the display 121 (STEP 12) and, then, advances to the STEP 10. Hence, when the CPU 126 decides that the sheet sensor 118 has not been turned on at the STEP 3 and if the bottom plate 34 is not in the sheet supply position, the bottom plate 34 is lowered to the sheet supply position.

In summary, it will be seen that the present invention provides a sheet feed device which prevents a sheet feed tray loaded with a stack of sheets from being incompletely raised to a sheet feed position or from accidentally collapsing from the sheet feed position. This advantage is derived from the fact that a uniquely designed gearing serves to transmit the rotation of a reversible motor to the bottom plate of the tray and, in addition, the bottom plate is raised and lowered by the reversible rotation of the motor.

Various modifications will become possible for those skilled in the art after receiving the teaching of the present disclosure without departing from the scope thereof. For example, the gears 84-92 used in the illustrative embodiment for transmitting the rotation of the motor 80 to the bottom plate 34 of the tray 30 may be replaced with a sprocket and chain device or the like.

What is claimed is:

1. A sheet feed device for feeding sheets which are stacked on a movable bottom plate of a sheet feed tray one by one toward a predetermined position inside of an apparatus in which the tray is mounted, comprising:

a reversible motor selectively rotatable in opposite directions;

a raising and lowering member for selectively raising the bottom plate of the sheet feed tray to a first predetermined position and lowering the bottom plate to a second predetermined position;

a gearing continuously coupled to said motor for transmitting the reversible rotation of the motor to said raising and lowering member, including a first gear continuously operatively coupled to an output shaft of said motor and a second gear continuously coupled to said first gear, and coupling means for axially coupling said second gear to said raising and lowering means when said tray is positioned in said apparatus, said coupling means producing an axial movement of said second gear in response to positioning of said tray into said apparatus and said first gear producing a rotating movement of the second gear in response to rotation of a shaft of said motor, with the axial movement of said second gear effecting coupling of said second gear to said raising and lowering member so that the rotating movement of said second gear effects movement of said raising and lowering member;

a tray cover position sensor for sensing an open position and a closed position of a tray cover; and control means for driving the motor in one direction responsive to an output of said tray cover position sensor which is indicative of the closed position of the tray cover and in the other direction responsive to an output of the tray cover position sensor which is indicative of the open position of the tray cover;

the raising and lowering member raising the bottom plate of the sheet feed tray responsive to the rotation of the motor in said one direction and lowering the bottom plate responsive to the rotation of the motor in said other direction.

2. A sheet feed device as claimed in claim 1, wherein the gearing comprises a gear train which is made up of a plurality of gears including said first and second gear, said first gear being at one end of said gear train operatively connected to said output shaft of the motor and said second gear being at the other end of the gear train for coupling to the raising and lowering member.

3. A sheet feed device as claimed in claim 2, wherein said coupling means comprises a pin extending from and axially of said second gear.

4. A sheet feed device as claimed in claim 3, wherein said coupling means further comprises a lever which is included in the raising and lowering member, said pin being engageable with said lever from below to raise and lower the lever responsive to rotation of said second gear.

5. A sheet feed device as claimed in claim 1, further comprising a bottom plate up sensor for sensing the first predetermined position of the bottom plate, said control means being constructed to drive the motor in said one direction when said bottom plate up sensor fails to sense the first predetermined position of the bottom plate after the tray cover position sensor has sensed the closed position of the tray cover.

6. A sheet feed device as claimed in claim 1, further comprising a bottom plate down sensor for sensing the second predetermined position of the bottom plate, said control means being constructed to drive the motor in said other direction when said bottom plate down sensor fails to sense the second predetermined position of the bottom plate after the tray cover position sensor has sensed the open position of the tray cover.

7. A sheet feed device as claimed in claim 1, wherein the control means comprises a microcomputer.

8. A sheet feeding device for feeding sheets which are stacked on a movable bottom plate of a sheet feed tray one by one toward a predetermined position inside of an apparatus in which the tray is mounted, comprising:

a reversible motor selectively rotatable in opposite directions;

a raising and lower member for selectively raising the bottom plate of the sheet feed tray to a first predetermined position and lowering the bottom plate to a second predetermined position, said raising and lowering member being installed in the apparatus;

gearing continuously coupled to said motor for transmitting rotation of said motor to said raising and lowering member, including a first gear continuously operatively coupled to an output shaft of said motor and a second gear continuously coupled to said first gear, and coupling means for axially coupling said second gear to said raising and lowering member when said tray is positioned in said apparatus, said coupling means producing an axial movement of said second gear in response to positioning of said tray into said apparatus so that said second gear couples to said raising and lowering member upon positioning of said tray into said apparatus, said first gear producing a rotating movement of said second gear in response to rotation of said motor to produce a movement in said raising and lowering member when said second gear is coupled to said raising and lowering member;

a tray cover position sensor for sensing a closed position of a tray cover;

control means for driving said motor in one direction for raising the bottom plate by means of the raising and lowering member responsive to an output of said tray cover position sensor which is indicative of the closed position of the tray cover;

whereby sheets are supplied as desired by opening the tray cover while maintaining the sheet feed tray inserted in the apparatus; and a bottom plate up sensor for sensing the first predetermined position of the bottom plate, said control means being constructed to drive the motor in said one direction when said bottom plate up sensor fails to sense the first predetermined position of the bottom plate after the tray cover position sensor has sensed the closed position of the tray cover.

9. A sheet feed device as claimed in claim 8, wherein the gearing comprises a gear train which is made up of a plurality of gears, including said first and second gears, said first gear being at one end of said gear train operatively connected to said output shaft of the motor and said second gear being at the other end of the gear train for coupling to the raising and lowering member.

10. A sheet feed device as claimed in claim 9, wherein said coupling means comprises a pin extending from and axially of said second gear.

11. A sheet feed device as claimed in claim 10, wherein said coupling means further comprises a lever which is included in the raising and lowering member, said pin being engageable with said lever from below to raise and lower the lever responsive to rotation of said second gear.

12. A sheet feed device as claimed in claim 8, further comprising a bottom plate down sensor for sensing the second predetermined position of the bottom plate, said control means being constructed to drive the motor in the other direction when said bottom plate down sensor fails to sense the second predetermined position of the bottom plate after the tray cover position sensor has sensed the open position of the tray cover.

13. A sheet feed device as claimed in claim 8, wherein the control means comprises a microcomputer.

14. A sheet feeding device for feeding sheets which are stacked on a movable bottom plate of a sheet feed tray one by one toward a predetermined position inside of an apparatus in which the tray is mounted, comprising:

a reversible motor selectively rotatable in opposite directions;

a raising and lowering member for selectively raising the bottom plate of the sheet feed tray to a first predetermined position and lowering the bottom plate to a second predetermined position, said raising and lowering member being installed in the apparatus;

gearing continuously coupled to said motor for transmitting rotation of said motor to said raising and lowering member, including a first gear continuously operatively coupled to an output shaft of said motor and a second gear continuously coupled to said first gear, and coupling means for axially coupling said second gear to said raising and lowering member when said tray is positioned in said apparatus, said coupling means producing an axial movement of said second gear in response to positioning of said tray into said apparatus so that said second gear couples to said raising and lowering member upon positioning of said tray into said apparatus, said first gear producing a rotating movement of said second gear in response to rotation of said motor to produce a movement in said raising and lowering member when said second gear is coupled to said raising and lowering member;

a tray cover position sensor for sensing an open position of a tray cover;

control means for driving said motor in one direction for lowering the bottom plate by means of the raising and lowering member responsive to an output of said tray cover position sensor which is indicative of the open position of the tray cover;

whereby sheets are supplied as desired by opening the tray cover while maintaining the sheet feed tray inserted in the apparatus; and a bottom plate down sensor for sensing the second predetermined position of the bottom plate, said control means being constructed to drive the motor in said one direction when said bottom plate down sensor fails to sense the second predetermined position of the bottom plate after the tray cover position sensor has sensed the open position of the tray cover.

* * * * *